US011031216B2

(12) United States Patent
Huang et al.

(10) Patent No.: US 11,031,216 B2
(45) Date of Patent: Jun. 8, 2021

(54) MASS SPECTROMETRY DATA ACQUISITION METHOD

(71) Applicant: SHIMADZU CORPORATION, Kyoto (JP)

(72) Inventors: Yunqing Huang, Shanghai (CN); Wenjian Sun, Shanghai (CN); Xiaoqiang Zhang, Shanghai (CN)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 16/603,634

(22) PCT Filed: May 30, 2017

(86) PCT No.: PCT/JP2017/019990
§ 371 (c)(1),
(2) Date: Oct. 8, 2019

(87) PCT Pub. No.: WO2018/211714
PCT Pub. Date: Nov. 22, 2018

(65) Prior Publication Data

US 2020/0135440 A1 Apr. 30, 2020

(30) Foreign Application Priority Data

May 15, 2017 (CN) ..... 201710337936.7

(51) Int. Cl.
*H01J 49/00* (2006.01)
*H01J 49/42* (2006.01)

(52) U.S. Cl.
CPC ..... *H01J 49/0031* (2013.01); *H01J 49/0045* (2013.01); *H01J 49/427* (2013.01)

(58) Field of Classification Search
CPC .... H01J 49/00; H01J 49/0031; H01J 49/0027; H01J 49/0036; H01J 49/0045; H01J 49/005; H01J 49/02; H01J 49/26
(Continued)

(56) References Cited

U.S. PATENT DOCUMENTS

2009/0072132 A1 3/2009 Manri et al.
2010/0311097 A1 12/2010 Anderson
(Continued)

FOREIGN PATENT DOCUMENTS

JP 2009068981 A 4/2009
JP 2009156722 A 7/2009
(Continued)

OTHER PUBLICATIONS

SIPO, "Chinese Office Action for CN Application No. 201710337936.7", China, dated Jan. 13, 2020.
(Continued)

*Primary Examiner* — Jason L McCormack
(74) *Attorney, Agent, or Firm* — Tim Tingkang Xia, Esq.; Locke Lord LLP

(57) ABSTRACT

A data acquisition method for a mass spectrometer includes providing at least one ion source for generating ions; not fragmenting or less fragmenting the ions when a collision cell is in a first working mode; recording a mass spectrum of the ions generated in the first working mode; selecting more than one ion from the ions, the more than one ion being distributed in a plurality of discontinuous mass-to-charge ratio channels; partially fragmenting the selected ions when the collision cell is in a second working mode; recording a mass spectrum of the ions generated in the second working mode; and, repetitively executing the above steps for several times. The ions distributed in the discontinuous mass-to-charge ratio channels is always selected during the subse-
(Continued)

quent repeated execution, until the ion intensity of the selected ions is less than a set value.

29 Claims, 5 Drawing Sheets

(58) Field of Classification Search
USPC ..... 250/281, 282
See application file for complete search history.

(56) References Cited

U.S. PATENT DOCUMENTS

| | | | | |
|---|---|---|---|---|
| 2014/0239170 | A1 | 8/2014 | Okumura | |
| 2016/0305953 | A1 | 10/2016 | Coon et al. | |
| 2017/0370889 | A1* | 12/2017 | Remes | G01N 30/8637 |
| 2018/0240658 | A1* | 8/2018 | Cox | H01J 49/0031 |

FOREIGN PATENT DOCUMENTS

| | | | |
|---|---|---|---|
| JP | 2014165053 | A | 9/2014 |
| JP | 2016501009 | A | 1/2016 |
| WO | 2009107316 | A1 | 9/2009 |
| WO | 2014066117 | A | 5/2014 |
| WO | 2016055888 | A1 | 4/2016 |

OTHER PUBLICATIONS

EPO (ISR/EP), "International Search Report for PCT Application No. PCT/JP2017/019990", NL, dated Apr. 5, 2018.
SIPO, "Chinese Office Action for CN Application No. 2017103379361", China, dated Aug. 6, 2019.
Ducret, Axel et al., "High throughput protein characterization by automated reverse-phase chromatography/electrospray tandem mass spectrometry", Protein Science, 1998, pp. 706-719.
Ledvina, A. R. et al., "Increased Throughput of Proteomics Analysis by Multiplexing High-Resolution Tandem Mass Spectra", Analytical Chemistry, 2011, pp. 7651-7656, vol. 83.
Wilson, Jonathan et al., "Multiplexed MS/MS in a Quadrupole Ion Trap Spectrometer", Analytical Chemistry, 2004 pp. 7346-7353, vol. 76.
Li, Yuanyue et al., "Group-DIA: analyzing multiple data-independent acquisition mass spectrometry data files", Nature Methods, pp. 1105-1106, Dec. 2015, vol. 12, No. 12.
JPO, "Japanese Office Action for Application No. JP 2019-560792", Japan, dated Oct. 6, 2020.

* cited by examiner

[Fig. 1]
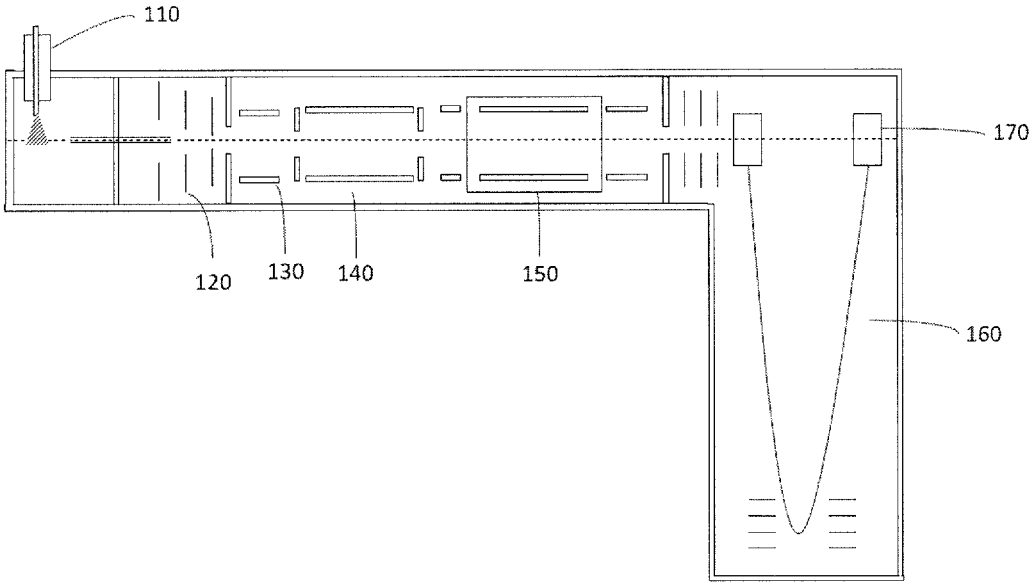
[Fig. 2]
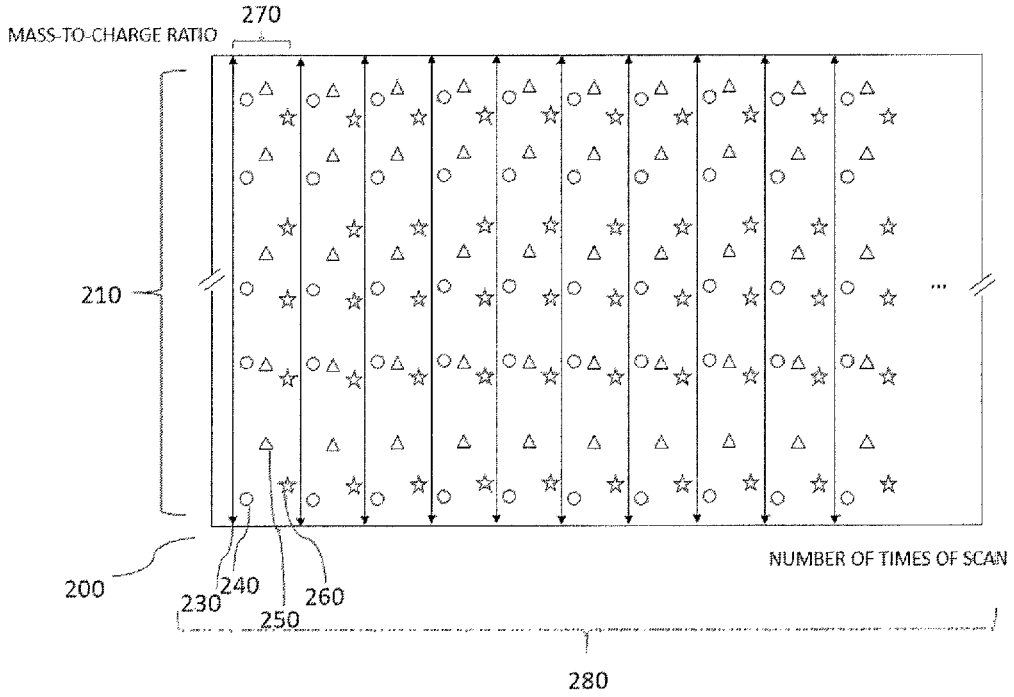

[Fig. 3]
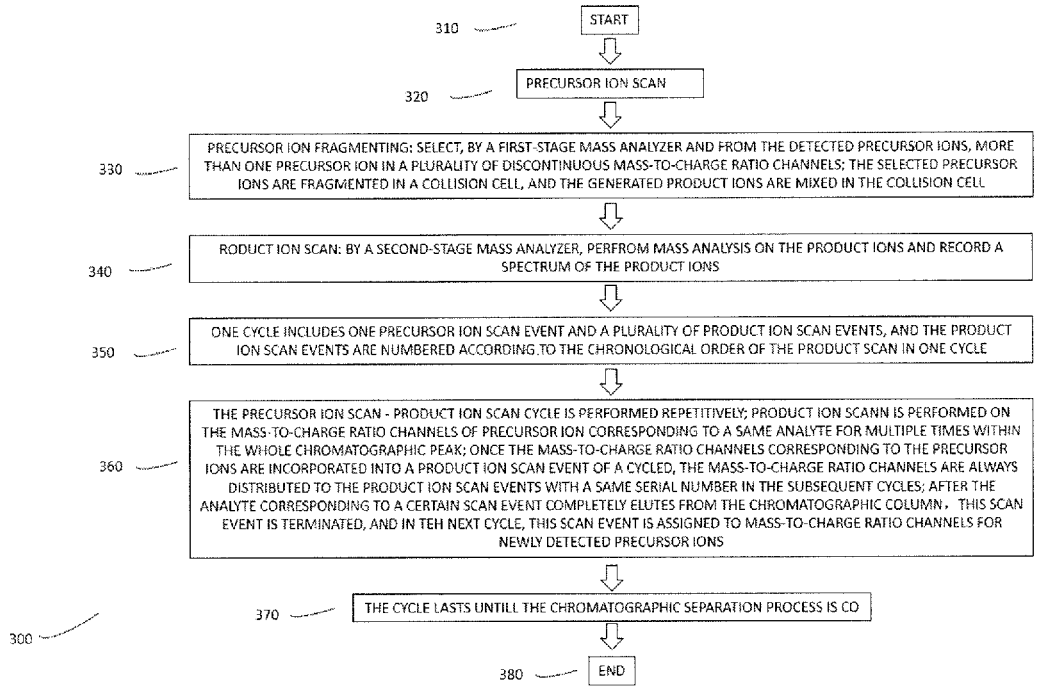
[Fig. 4]
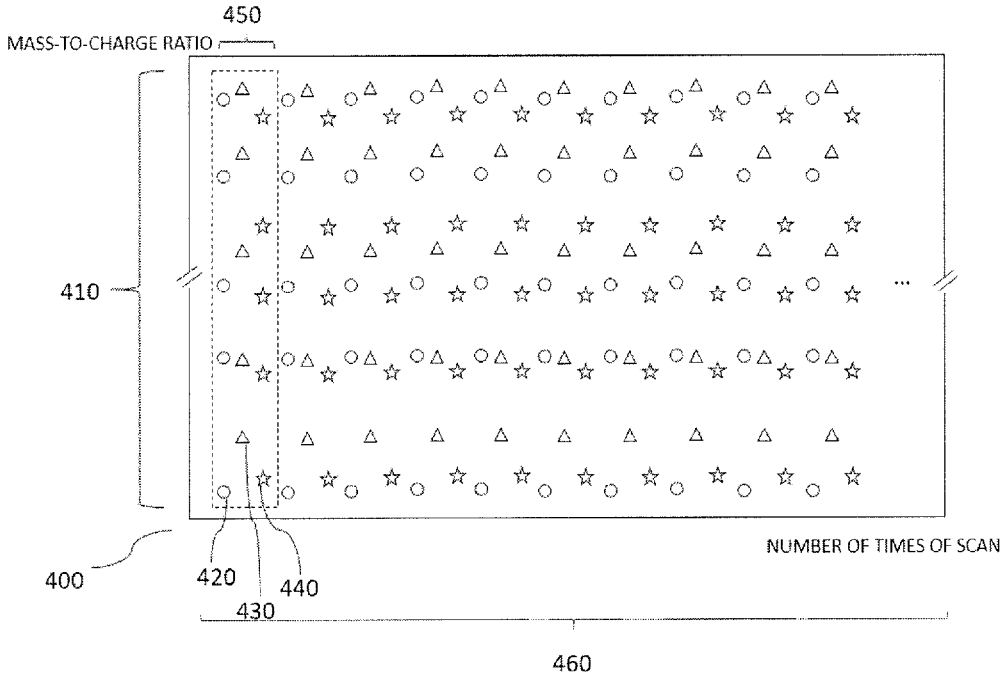

[Fig. 5]
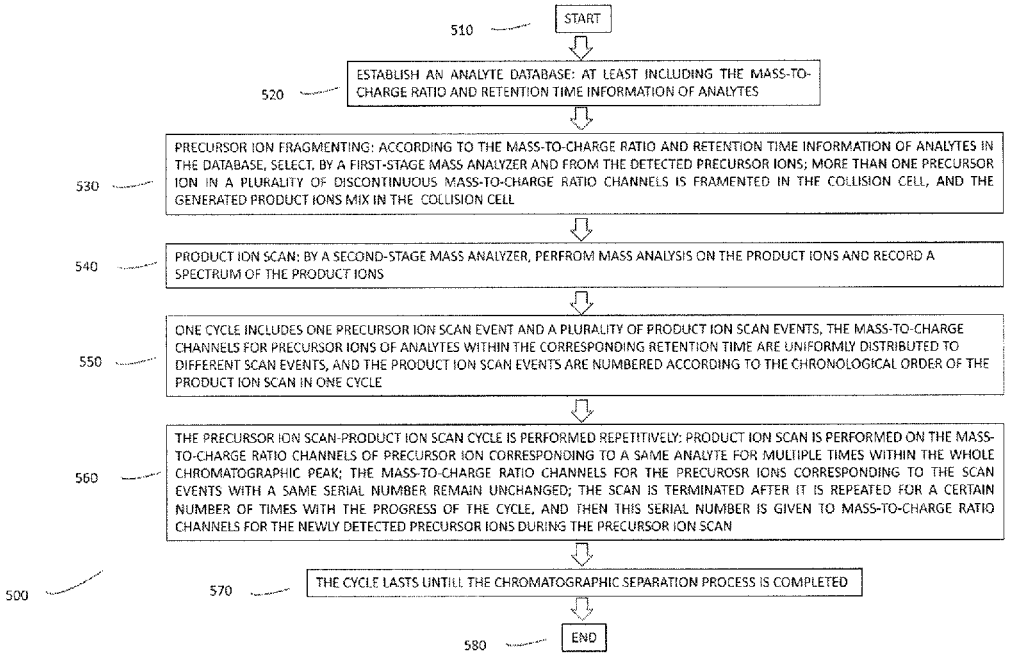
[Fig. 6]
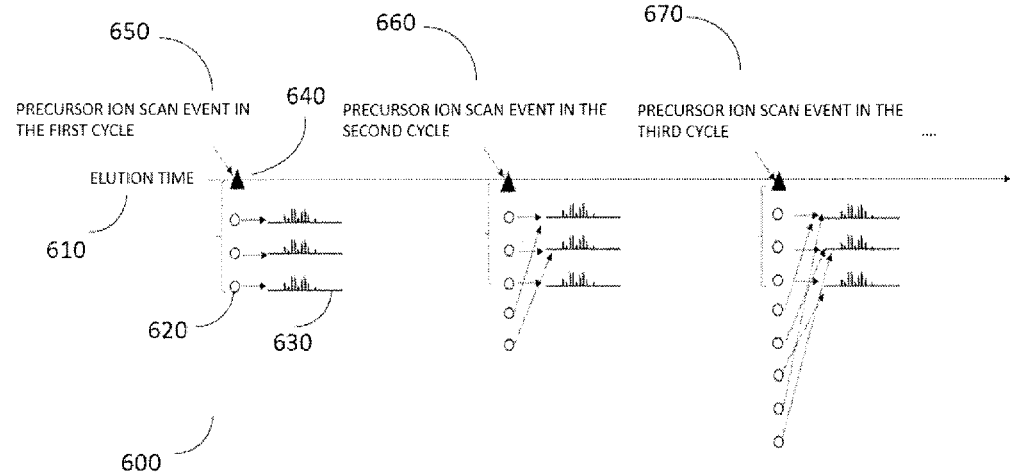

[Fig. 7]
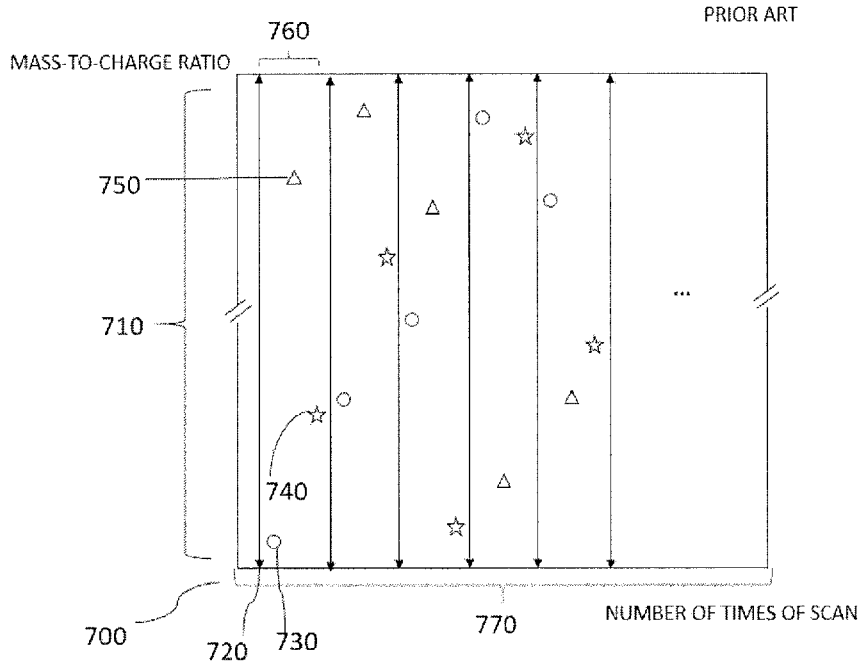
[Fig. 8]
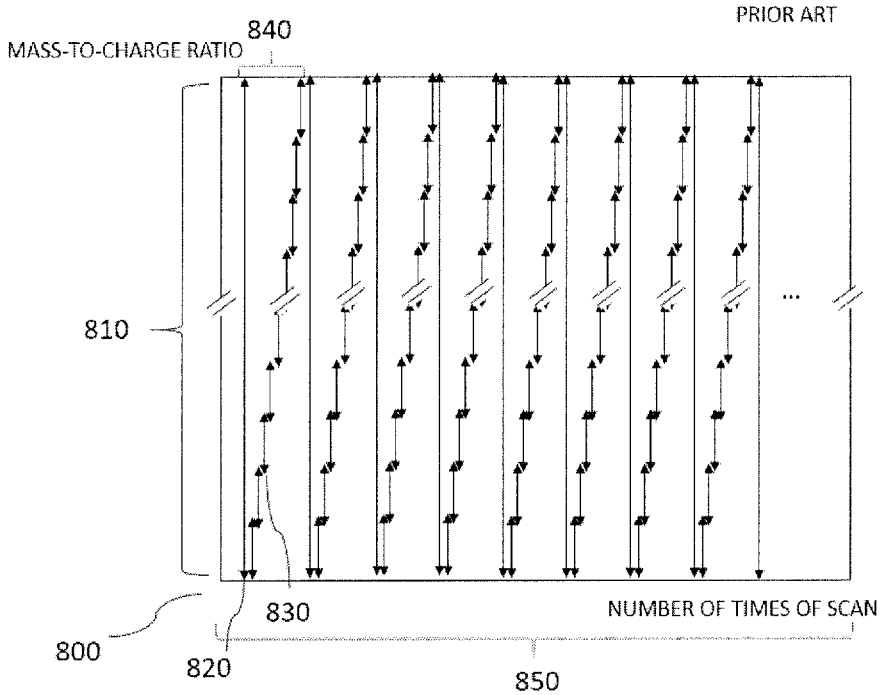

[Fig. 9A]
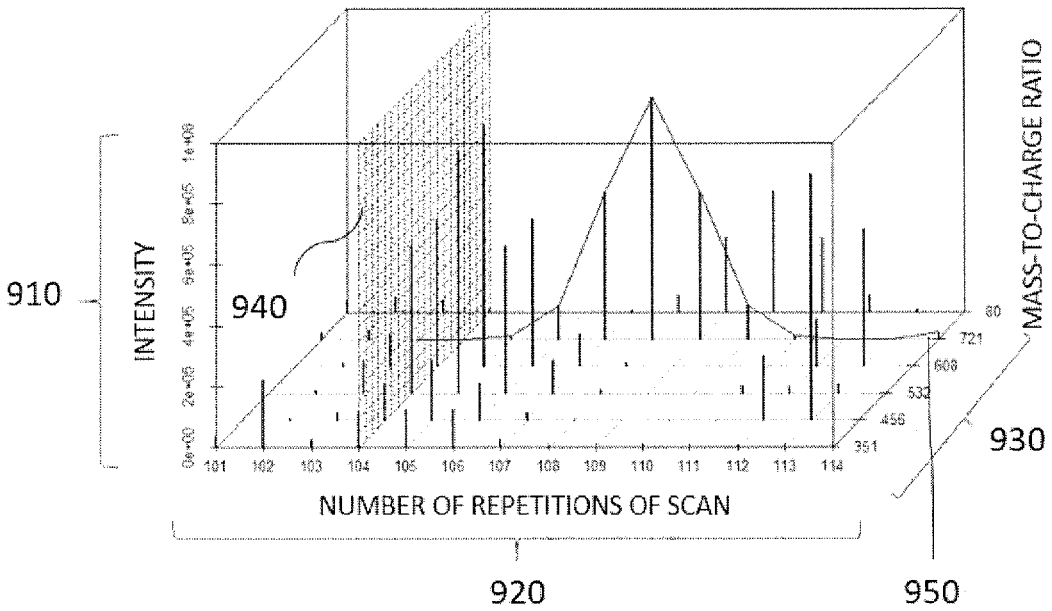
[Fig. 9B]
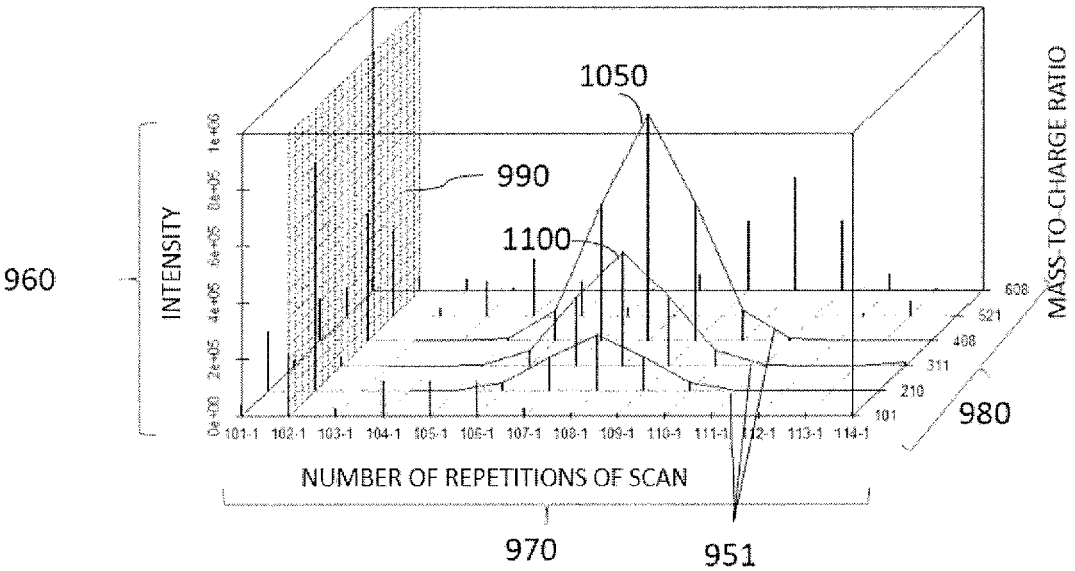

MASS SPECTROMETRY DATA ACQUISITION METHOD

CROSS-REFERENCE TO RELATED PATENT APPLICATIONS

This application is a U.S. national stage entry of PCT Application Serial No. PCT/JP2017/019990, filed May 30, 2017, which claims priority to and the benefit of, Chinese Patent Application Serial No. 201710337936.7, filed May 15, 2017, which are incorporated herein by reference in their entireties.

FIELD OF INVENTION

The present invention relates to the field of mass spectrometry data acquisition, and in particular to a mass spectrometry data acquisition method which has a high ion duty cycle and may perform quantitative analysis by using an ion current chromatogram of product ions.

BACKGROUND OF INVENTION

Due to their characteristics of high sensitivity and good selectivity, mass spectrometers have been widely applied in the analysis of complex samples. Particularly, since soft ionization techniques represented by electrospray ionization were invented, mass spectrometers have been more widely applied in the analysis of organic compounds.

Common organic compounds, which can be analyzed qualitatively and quantitatively by mass spectrometers, include proteins, polypeptides, metabolites, medicines, narcotic drugs, pesticides and the like. Since complex samples contain a huge number of substances, high-resolution mass spectrometers and tandem mass spectrometers have been increasingly employed due to their high parsing capability.

With the advantages of both the high-resolution mass spectrometry and the tandem mass spectrometry, the high-resolution tandem mass spectrometry technology has the highest parsing capability among all mass spectrometers. As a manifestation, during the LC-MS analysis, an ion current chromatogram of product ions has a higher signal-to-noise ratio and better impurity interference resistance, and meanwhile a spectrum of product ions may provide effective reference information for the structural analysis of an analyte. At present, common high-resolution tandem mass spectrometry include tandem Quadrupole Time-Of-Flight (QTOF) mass spectrometry, tandem Ion Trap Time-Of-Flight (IT-TOF) mass spectrometry, tandem quadrupole orbitrap mass spectrometry, tandem iontrap orbitrap mass spectrometry and the like.

Omics research may greatly enhance the understanding of the operating principle of living entities, and thus facilitate the development of new medical schemes and new medicines. At present, the omics analysis mainly includes genomic analysis, proteomic analysis and metabolomic analysis, where the genome analysis mainly depends upon a gene sequencing method, and both the proteome analysis and the metabolome analysis depend upon a mass spectrometry method with a high parsing capability.

Although a rapid progress has been achieved in the resolution of the mass spectrometers and in the tandem mass spectrometry, the mass spectrometers are still unable to overcome all difficulties when facing a huge number of substances in the omics analysis. For the complex samples, it is very important to improve data acquisition strategies for the mass spectrometers. In order to increase the coverage of polypeptides in the proteome analysis, Ducret et al. proposed a data-dependent acquisition scheme in 1998 (Protein Sci. 1998, 7 (3), 706-719). This scheme includes the following steps: 1) the preceding mass analyzer of a tandem quadrupole time-of-flight mass spectrometer does not perform mass selection, and the time-of-flight mass analyzer scans precursor ions within the concerned mass range when a collision cell operates in a low collisional energy mode; 2) according to the precursor ion information measured in the precursor ion scan step, mass-to-charge ratio channels for several precursor ions with the highest abundance serve as candidate ion mass-to-charge ratio channels; precursor ions in one mass-to-charge ratio channel are selected every time by a quadrupole mass analyzer at the front end of the collision cell and then fed into the collision cell; when the collision cell operates in a high fragmenting energy mode, the precursor ions are fragmented, and a mass spectrum of the generated product ions is recorded by a time-of-flight mass analyzer; and the complete monitoring of the plurality of candidate ion mass-to-charge ratio channels requires many times of fragmenting and product ion scan; and, (3) one precursor ion scan event and several product ion scan events form one cycle, and a next cycle will be performed after one cycle ends.

This data-dependent acquisition method solves the problem of low analyte coverage of tandem mass spectrometry analysis to a certain extent. However, since the product ion information of only one precursor ion mass-to-charge ratio channel can be monitored by one product ion scan, the duty cycle and throughput are low for the tandem mass spectrometry analysis. When a large number of analytes elute from a chromatographic column, many precursor ions with comparatively low abundance are still not monitored. Meanwhile, since the mass-to-charge ratio channels of the precursor ions corresponding to the product ion scan events in each cycle change constantly, it cannot be ensured that the product ions of the analytes are uniformly detected for multiple times within the chromatographic elution time, and quantitative analysis can only be performed by using an ion current chromatogram of the precursor ions of the analytes rather than an ion current chromatogram of the product ions, so that the selectivity and precision of the quantitative analysis in the omics research is reduced.

As an improvement of the data-dependent acquisition method, multiplex precursor ion reaction monitoring (PRM) is proposed, wherein precursor ions in a plurality of mass-to-charge ratio channels are successively fed into a collision cell for fragmenting, and product ions of the precursor ions in the plurality of mass-to-charge ratio channels are mixed in the collision cell and then analyzed in mass to charge ratio by a next-stage high-resolution mass analyzer (Analytical Chemistry 2011, 83 (20), 7651-7656.). Since the obtained mass spectrum of the product ions is a mixed spectrum of the precursor ions corresponding to the plurality of mass-to-charge ratio channels, it is required to perform deconvolution by using a relationship between the mass of two complementary product ions of a peptide and the mass of the precursor ion of this peptide, so as to restore a mass spectrum of product ions of a single peptide. Limited to the used deconvolution step, this method is merely suitable for the proteomics research rather than the metabolomics research. In addition, the selection of precursor ions corresponding to the product ion scan events in each scan cycle are similar to that of the data-dependent acquisition method, which makes PRM not suitable for quantitative analysis by using the ion current chromatogram of product ions.

The data-independent acquisition strategy proposed by Wilson et al. (Analytical Chemistry 2004, 76 (24), 7346-7353) well solves the difficulty that an ion current chromatogram of product ions cannot be used for quantitative analysis. The data-independent acquisition method is implemented in an ion trap in the initial stage, while this method is mainly used in the omics analysis by a tandem quadrupole time-of-flight mass spectrometer in the later stage (Nat Meth 2015, (12), 1105-1106; U.S. Pat. No. 8,809,772B2). In the data-independent acquisition strategy, the full mass-to-charge ratio range of precursor ions is evenly divided into a number of mass-to-charge windows, each having a width of 10-30 amu, and precursor ion fragmenting and product ion scan are performed for each mass-to-charge window. Compared with the conventional data-dependent acquisition methods, by this method, product ions of the precursor ions may be uniformly acquired for multiple times during the chromatographic elution time of the analyte, and therefore, the ion current chromatogram of the product ions may be used for quantitative analysis. However, in this method, product ion scans are performed indiscriminately for all mass-to-charge windows, including mass-to-charge ratio windows without precursor ions, so that the scan capability of the mass spectrometer is not fully utilized and the duty cycle can be still improved further.

SUMMARY OF THE INVENTION

In view of the defects in the prior art, an objective of the present invention is to provide a novel mass spectrometry data acquisition method in order to solve the problems in the prior art.

To achieve this objective and other related objectives, the present invention provides a data acquisition method for a mass spectrometer, mainly including the following steps of: a. providing at least one ion source for generating ions; b. not fragmenting or less fragmenting the ions when a collision cell is in a first working mode; c. recording a mass spectrum of the ions generated in the first working mode as a first fragmenting spectrum; d. selecting more than one ion from the ions, the more than one ion being distributed in a plurality of discontinuous mass-to-charge ratio channels; e. fragmenting at least part of the selected ions distributed in the discontinuous mass-to-charge ratio channels when the collision cell is in a second working mode; f. recording a mass spectrum of the ions generated in the second working mode as a second fragmenting spectrum; and, g. repetitively executing the steps b-f for several times, wherein the mass-to-charge ratio channels corresponding to the ions selected in the previous step d are always selected in subsequent repetitive executions, until the ion intensity of the ions generated by the ion source is lower than a set threshold.

As a preferred solution, the data acquisition method is applied to data acquisition of a chromatography-mass spectrometry system. Further, ions present in the first fragmenting spectrum and ions present in the second fragmenting spectrum are associated with each other according to the elution time of a chromatographic peak occurs; or, ions present in the first fragmenting spectrum and ions present in the second fragmenting spectrum may be associated with each other according to the shape of a chromatographic peak; or, ions present in the first fragmenting spectrum and ions present in the second fragmenting spectrum may be associated with each other according to both the elution time and the shape of the chromatographic peak.

As another preferred solution, the number of mass-to-charge ratio channels for the selected ions is not greater than a set numerical value. Further, the set numerical value is changed in real time according to the complexity of a sample to be analyzed. Further, when the number of mass-to-charge ratio channels for the selected ions does not increase any more or reaches the set numerical value, the selection may be terminated after the steps b-f are further repetitively executed for a preset number of times, and a new selection will be activated when the steps b-f are further executed next time.

As another preferred solution, during one repetitive executions of the steps b-f, the step d further includes the step of selecting more than one ion from the generated ions in multiple batches; and, the step f further includes the step of respectively recording a mass spectrum of ions originated from fragmentation in each batch as a second fragmenting spectrum thereof. Further, during the selections in multiple batches, the mass-to-charge ratio channels for the ions selected in respective batches are different. Further, when the number of mass-to-charge ratio channels for the selected ions does not increase any more or reaches a set numerical value during the selection in a certain batch, the selection in this batch may be terminated after the steps b-f are further repetitively executed for a preset number of times. Further, the mass-to-charge ratio channels for the generated ions may be uniformly distributed in the selections of different batches.

As another preferred solution, the mass-to-charge ratio channels have a mass-to-charge ratio width of greater than 1 amu.

As another preferred solution, the selected ions simultaneously enter the collision cell, or successively enter the collision cell depending on different mass-to-charge channels.

To achieve this objective and other related objectives, the present invention further provides a second data acquisition method for a mass spectrometer, mainly including the following steps of: a. providing at least one ion source for generating ions; b. selecting more than one ion from the ions, the more than one ion being distributed in a plurality of discontinuous mass-to-charge ratio channels; c. allowing the selected ions to pass through a collision cell to be at least partially fragmented; d. recording a mass spectrum of the ions generated in the step c; and, e. repetitively executing the steps b-d for several times, wherein, each time the step b is executed, the ions, which are distributed in the discontinuous mass-to-charge ratio channels, selected in the previous step b are always selected, until the ion intensity of the selected ions is lower than a set threshold.

As a preferred solution of the second data acquisition method, after the steps b-d are repetitively executed for a preset number of times, the selection is terminated, and a new selection will be activated when the steps b-d are repetitively executed next time.

As a preferred solution of the second data acquisition method, during one repetitive implementation of the steps b-d, the step b further includes the step of selecting more than one ion from the generated ions in multiple batches; and, the step d further includes the step of respectively recording a mass spectrum of ions originated from fragmentation in each batch. Further, during the selections in multiple batches, the mass-to-charge ratio channels for the ions selected in respective batches are different. Further, after the selection in a certain batch, among the selections in multiple batches, has been repetitively executed for a preset number of times, the selection in this batch may be terminated. Further, during the selections in multiple batches, the mass-to-charge ratio channels for the selected ions may be determined according to a database in advance. Further, during the selections in multiple batches, the number of repetition times and the starting/ending time in each batch may be determined according to a database in advance. Furthermore, the database is generated by simulation software, or may be generated by chromatography-mass spectrometry analysis performed in advance.

As a preferred solution of the second data acquisition method, the mass-to-charge ratio channels have a mass-to-charge ratio width of greater than 1 amu.

As a preferred solution of the second data acquisition method, the selected ions simultaneously enter the collision cell, or successively enter the collision cell depending on different mass-to-charge channels.

As a preferred solution of the second data acquisition method, after the mass spectrum is obtained, a database containing pre-stored mass spectra of known substances is retrieved to judge whether the acquired mass spectrum corresponds to one or more known substances. Further, the retrieving process includes the following steps of: a) obtaining, from the database, mass spectra of the known substances; b) generating a time-varying ion current chromatogram from product ions present in the mass spectra of the known substances; and, c) calculating, according to the obtained ion current chromatogram and the mass spectra of the known substances, a score for judging whether the known substances have been detected. Further, a quantitative numerical value of the known substances is calculated according to the ion current chromatogram.

To achieve this objective and other related objectives, the present invention further provides a third data acquisition method for a mass spectrometer, mainly including the following steps of: a. providing at least one ion source for generating ions; b. the ions bypassing a collision cell to be not fragmented or partially fragmented; c. recording a mass spectrum of the ions as a first fragmenting spectrum; d. selecting more than one ion from the ions, the more than one ion being distributed in a plurality of discontinuous mass-to-charge ratio channels; e. allowing the selected ions to pass through the collision cell to be at least partially fragmented; f. recording a mass spectrum of the ions generated in the step e as a second fragmenting spectrum; and, g. repetitively executing the steps b-f for several times, wherein, when the step d is repetitively executed, the ions, which are distributed in the discontinuous mass-to-charge ratio channels, selected in the previous step d are always selected, until the ion intensity of the selected ions is lower than a set threshold.

As a preferred solution of the third data acquisition method, during one repetitive executions of the steps b-f, the step d further comprises the step of selecting more than one ion from the generated ions in multiple batches; and, the step f further comprises the step of respectively recording a mass spectrum of ions originated from fragmentation in each batch as a second fragmenting spectrum thereof. Further, during the selections in multiple batches, the mass-to-charge ratio channels for the ions selected in respective batches are different. Further, when the number of mass-to-charge ratio channels for the selected ions does not increase any more or reaches a set numerical value during the selection in a certain batch, the selection in this batch may be terminated after the steps b-f are further repetitively executed for a preset number of times. Further, the mass-to-charge ratio channels for the ions may be uniformly distributed in the selections in different batches.

As a preferred solution of the third data acquisition method, the selected ions simultaneously enter the collision cell, or successively enter the collision cell depending on different mass-to-charge channels.

As described above, the mass spectrometry data acquisition method of the present invention has the following beneficial effects: a higher ion duty cycle is realized in the tandem mass spectrometry; moreover, the mass spectrometry data acquisition method may perform quantitative analysis by using an ion current chromatogram, and has a higher quantitative accuracy than the conventional data-dependent acquisition methods.

BRIEF DESCRIPTION OF THE DRAWINGS

FIG. 1 shows a structural diagram of a preferred mass spectrometer capable of implementing a mass spectrometry data acquisition method according to the present invention.

FIG. 2 shows a schematic diagram of a preferred mass spectrometry data acquisition method according to the present invention.

FIG. 3 shows a working flowchart corresponding to the mass spectrometry data acquisition method of FIG. 2.

FIG. 4 shows a schematic diagram of another preferred mass spectrometry data acquisition method according to the present invention.

FIG. 5 shows a working flowchart corresponding to the mass spectrometry data acquisition method of FIG. 4.

FIG. 6 shows a schematic diagram a preferred scheme for distributing precursor ions to product ion scan events corresponding to the mass spectrometry data acquisition method of FIG. 2 and FIG. 3.

FIG. 7 shows a schematic diagram of a data-dependent acquisition method in the prior art.

FIG. 8 shows a schematic diagram of a data-independent acquisition method including precursor ion scan in the prior art.

FIG. 9A show analysis charts of data instances corresponding to the mass spectrometry data acquisition method of FIG. 2 and FIG. 3.

FIG. 9B show analysis charts of data instances corresponding to the mass spectrometry data acquisition method of FIG. 2 and FIG. 3.

DESCRIPTION OF VARIOUS EMBODIMENTS

Implementations of the present invention will be described below by specific embodiments, and other advantages and effects of the present invention may be easily understood by those skilled in the art from the contents disclosed in the specification. The present invention may also be implemented or applied by additional different specific implementations. The details in the specification may be based on different standpoints and applications, and various modifications or alterations may be made to the details without departing from the spirit of the present invention. It is to be noted that the following embodiments and the features in the embodiments may be combined if not conflict.

It is to be noted that, the drawings in the following embodiments are merely for illustratively describing the basic concept of the present invention. Therefore, only components involved in the present invention are shown in the drawings, and they are not drawn according to the number, shape and size of the components during actual implementations. Meanwhile, the shape, number and scale of the components may be changed arbitrarily during the actual implementations, and the layout form of the components may be more complicated.

An objective of the present invention is to provide a novel mass spectrum data collection method in order to significantly improve the ion utilization efficiency and quantitative ability during the tandem mass spectrometry analysis. The present invention will be described below in detail with reference to FIGS. 1-9B.

FIG. 1 shows a preferred mass spectrometer 100 capable of implementing the mass spectrometry data acquisition method according to the present invention. The mass spectrometer 100 includes an ion source 110, an ion focusing device 120, an ion transport device 130, a first-stage mass analyzer 140, a collision cell 150, an orthogonal acceleration reflective time-of-flight mass analyzer 160 and a detector 170.

In a preferred implementation, the mass spectrometer 100 is used in conjunction with a chromatograph, wherein the chromatograph may be a liquid chromatograph, a gas chromatograph, a capillary electrophoresis apparatus or the like. The mass spectrometry data acquisition method of the present invention will be described below in detail by taking a LC-MS as example.

Eluent from the liquid chromatograph is fed into the ion source 110 for ionization. As a preferred solution, the ion source 110 is an electrospray ion source. The analyte is ionized, then focused by the ion focusing device 120 and fed into the ion transport device 130. Ions are subsequently fed into the first-stage mass analyzer 140.

As a preferred solution, the first-stage mass analyzer 140 is a mass analyzer based on a quadrupole field, and may be a set of quadrupole rods, a three-dimensional ion trap, a linear ion trap or the like. The first-stage mass analyzer 140 may operate in a TTI (total transmission ion) mode. That is, ions within a full mass-to-charge ratio range are indiscriminately fed into the collision cell 150 and then the generated ions are transported into a next-stage mass analyzer 160. The first-stage mass analyzer 140 may also operate in an ion selection mode. That is, the ions are discriminately transported into the next-stage mass analyzer 160 via the collision cell 150.

For an analysis task in which the analytes are mainly low-mass ions, for example, the metabonomic analysis, the full mass-to-charge ratio range generally corresponds to a mass-to-charge ratio of m/z 100 to m/z 800. For an analysis task in which the analytes are mainly polypeptides, for example, the proteomic analysis, the full mass-to-charge ratio selection generally corresponds to a mass-to-charge ratio of m/z 400 to m/z 1400.

After leaving the first-stage mass analyzer 140, the ions enter the collision cell 150. The collision cell 150 may operate in a low fragmenting mode (a first working mode) or a high fragmenting mode (a second working mode). When the collision cell 150 operates in the low fragmenting mode, the ions entering the collision cell 150 are not fragmented or less fragmented. When the collision cell 150 operates in the high fragmenting mode, more ions are fragmented. After leaving the collision cell 150, the ions enter an orthogonal ion acceleration region. The accelerated ions are separated according to the mass-to-charge ratio in the time-of-flight mass analyzer 160, and they then successively reach the detector 170. The detector 170 may record mass spectra of the ions. At this moment, a mass spectrum of the ions recorded in the low fragmenting mode is used as a low fragmenting spectrum (a first fragmenting spectrum), and a mass spectrum of the ions recorded in the high fragmenting mode is used as a high fragmenting spectrum (a second fragmenting spectrum).

As a preferred mass spectrometer capable of implementing the mass spectrometry data acquisition method of the present invention, an ion switching device may be additionally provided in the front of the collision cell, and an ion channel parallel to the collision cell is additionally provided so that the ions may be less fragmented by the parallel ion channel. The ion switching device may guide precursor ions exiting the first-stage mass analyzer into the collision cell or the ion channel parallel to the collision cell. When a low fragmenting spectrum is to be recorded, the precursor ions are guided into the ion channel parallel to the collision cell; however, when a high fragmenting spectrum is to be recorded, the precursor ions are guided into the collision cell. At this time, the collision cell always operates in the high fragmenting mode, so that more precursor ions are fragmented. The mass spectrometry data acquisition method in the present invention may be implemented on the two types of mass spectrometers mentioned above.

FIG. 2 shows a preferred mass spectrometry data acquisition method named multiple data dependent acquisition which simultaneously select a plurality of precursor ions for multiple times for tandem mass spectrometry so as to cover all precursor ions, wherein the plurality of selected precursor ions are distributed in a plurality of discontinuous mass-to-charge channels and the number of mass-to-charge ratio channels for the selected precursor ions does not exceed a preset numerical value. The preset numerical value changes in real time according to the complexity of a sample to be analyzed. The specific description will be given as below. The horizontal axis of FIG. 2 represents the number of times of scan 280. The number of times of scan 280 corresponds to the elution time in the LC-MS analysis. One scan corresponds to one scan event, and as the analysis time increases, the number of times of scan also increases. Generally, the time for one scan is 0.02 s to 1 s, which varies according to the concentration of the analytes for QTOF (quadrupole-time-of-flight) mass spectrometer. As a preferred solution, the scan time for one scan may be set as 0.05 s. The vertical axis of FIG. 2 represents the mass-to-charge ratio 210, and the full range of the vertical axis corresponds to the full mass-to-charge ratio range. In FIG. 2, a line segment with double arrows, having the same height as the vertical axis, represents one scan event 230 for scan precursor ions within the full mass-to-charge ratio range; a combination of circles randomly distributed within the full mass-to-charge ratio range on the right of the line segment with double arrows represents one product ion scan 240 corresponding to the precursor ions in the plurality of mass-to-charge ratio channels, and the width of the mass-to-charge ratio channels is 1-3 amu; and, a combination of triangles and a combination of stars on the right of the combination of circles separately represent two product ion scan 250 and 260, which are similar to the product ion scan 240 and correspond to different mass-to-charge channel combinations. As an example, it is assumed that one cycle 270 only includes one precursor ion scan event and three product ion scan events. When one cycle ends, the next cycle will be proceeded. As a preferred solution, the number of scan events included in each cycle is consistent.

FIG. 3 shows a detailed flowchart of the data acquisition method of FIG. 2, and exhibits the whole process of multiple data-dependent acquisition by using the LC-MS. The first step is precursor ion scan 320. The first-stage or second-stage mass analyzer in the tandem mass spectrometer may be used for measuring the mass of precursor ions within the full mass-to-charge ratio range and recording the obtained mass spectrum of the precursor ions. As a preferred solution, the second-stage mass analyzer is a high-resolution mass analyzer, for example, a time-of-flight mass analyzer. Precursor ions corresponding to more than one mass-to-charge channel are selected, according to the spectrum obtained in the precursor ion scan 320 step, from the detected precursor ions, by using the mass analyzer in the front of the collision cell in the tandem mass spectrometer. The selected precursor ions simultaneously enter the collision cell or successively enter the collision cell depending on different mass-to-charge ratio channels. The precursor ions are fragmented 330 in the collision cell, and product ions originated from the precursor ions in a plurality of mass-to-charge ratio channels are mixed in the collision cell. The generated product ions are fed into the second-stage mass analyzer for mass analysis, and the obtained mass spectrum of the product ions is recorded. This is a product ion scan step 340. To complete one precursor ion scan-product ion scan cycle 350, following the precursor ion scan event, more than one precursor ion fragmenting-product ion scan event is performed successively, until all product ions corresponding to mass-to-charge ratio channels of the precursor ions with a certain abundance detected in the precursor ion scan event 320 are covered. At the end of one cycle, product ion scan events in this cycle are numbered according to the chronological order of product ion scan. To record analytes in the whole liquid chromatographic separation process, it is necessary to repetitively perform the precursor ion scan-product ion scan cycle 360. To realize the quantitative analysis of analytes, product ion scan will be performed on the precursor ions corresponding to the same analyte for multiple times within the whole chromatographic peak.

During the repetition of the scan cycle 360, once precursor ions in a certain mass-to-charge ratio channel enter the cycle, the precursor ions are always distributed to product ion scan events with the same serial number in the subsequent cycles. When the corresponding analyte in a certain scan event completely elute from a chromatographic column (for example, when the ion intensity of the precursor ions is lower than a set threshold), this scan event is terminated, and in the next cycle, this scan event will be given to mass-to-charge ratio channels for the newly detected precursor ions. The precursor ion scan-product ion scan cycle 370 is repeated until the chromatographic separation for one sample injection ends.

FIG. 4 shows another preferred mass spectrometry data acquisition method, and depicts another data acquisition method 400 slightly different from the method of FIG. 2, where precursor ions in a plurality of mass-to-charge ratio channels are simultaneously selected for multiple times by tandem mass spectrometry so as to cover all detected precursor ions in different mass-to-charge ratio channels. The specific description is given as below.

The horizontal axis of FIG. 4 represents the number of scan times 460. The number of scan times 460 corresponds to the elution time in the LC-MS analysis. One scan corresponds to one scan event, and the number of scan times increases with the elution time. Generally, the tandem quadrupole-time-of-flight mass spectrometer is used. The time for one scan is 0.02 s to 1 s, which varies according to the concentration of the analytes. As a preferred solution, the scan time for one scan (i.e., one scan event) may be set as 0.05 s. The vertical axis of FIG. 4 represents the mass-to-charge ratio 410. A combination of circles in the full mass-to-charge ratio range on the right of the vertical axis 410 represents one product ion scan 420 corresponding to the precursor ions in a plurality of mass-to-charge channels each having a width of 1-3 amu; and, a combination of triangles and a combination of stars on the right of the combination of circles separately represent two product ion scans 430 and 440, which are similar to the product ion scan 420 and correspond to different mass-to-charge channel combinations for precursor ions. As an example, it is assumed that one cycle 450 only includes one precursor ion scan event and three product ion scan events. When one cycle ends, a next cycle will be proceeded. As a preferred solution, the number of scan events included in each cycle is consistent, and the number of mass-to-charge ratio channels for precursor ions corresponding to each scan event is consistent. Different from the method of FIG. 2, the scan cycle in this method does not include the precursor ion scan event 230.

FIG. 5 shows a detailed flowchart of the data acquisition method of FIG. 4, and exhibits the whole process 500 of another preferred multiple data dependent acquisition by using the LC-MS. In the first step, an analyte database 520 is established by simulation software or in other ways. Aanalyte database may be formed by performing one chromatography-mass spectrometry analysis by data dependent acquisition (DDA) to acquire the precursor ion mass-to-charge ratio, product ion mass-to-charge ratio and retention time of a plurality of substances and then sorting the obtained information; or, an analyte database may be formed by predicting the precursor ion mass-to-charge ratio, retention time and product ion mass-to-charge ratio of a plurality of potential analytes by theoretical calculation and then sorting the obtained information; or, an analyte database may be formed by performing one chromatography-mass spectrometry analysis by full precursor ion scan to obtain the mass-to-charge ratio and retention time information of precursor ions and then sorting the obtained information. According to the precursor ion mass-to-charge ratio and retention time information of analytes in the database, within the elution time of the analytes, more than one precursor ion in different mass-to-charge ratio channels is selected by using the mass analyzer in the front of the collision cell in the tandem mass spectrometer, so that the precursor ions simultaneously enter the collision cell or successively enter the collision cell according to different mass-to-charge ratios. The precursor ions are fragmented 530 in the collision cell, and product ions from the precursor ions in the plurality of mass-to-charge ratio channels are mixed in the collision cell. The generated product ions are fed into the second-stage mass analyzer for mass analysis, and the obtained mass spectrum of the product ions is recorded. This is a product ion scan step 540. One cycle 550 includes one or more precursor ion fragmenting-product ion scan events. The precursor ions of the analytes eluted within the corresponding retention time are uniformly distributed to different scan events, and the product ion scan events are numbered according to the chronological order of product ion scan. To record the analytes in the whole liquid chromatographic separation process, it is necessary to repetitively perform the precursor ion fragmenting-product ion scan cycle 506. To realize the quantitative analysis of analytes, product ion scan will be performed on the precursor ion corresponding to the same analyte for multiple times within the whole chromatographic peak. In the next cycle, the mass-to-charge ratio channels for the precursor ions corresponding to the scan events with a sane serial number remain unchanged. Meanwhile, after a scan event is repeated for a certain number of times with the progress of scan cycle, this scan event is terminated, and this serial number is given to mass-to-charge channels for other precursor ions. The distribution of precursor ion channels within a certain chromatographic elution time depends upon the chromatographic retention time of precursor ions in the database. The precursor ion fragmenting-product ion scan cycle 570 is repeated until the chromatographic separation of one sample injection ends.

When the data acquisition method of FIG. 2 and FIG. 3 is performed by a mass spectrometer, it is required to dynamically distribute precursor ions in different mass-to-charge ratio channels into product ion scan events in real time. To realize more effective distribution and meanwhile minimize the mutual interference of product ions of precursor ions in a plurality of mass-to-charge ratio channels, FIG. 6 shows a scheme 600 for distributing precursor ions to product ion scan events as another preferred solution.

For convenience of description, the number of precursor ion fragmenting-product ion scan events in one cycle is set as 3, and the number of precursor ion mass-to-charge ratio channels corresponding to each product ion scan event is 3 at most. The straight line with a single arrow in FIG. 6 represents the elution time 610 of the liquid chromatograph, where the elution time gradually increases from left to right. Each hollow circle represents the precursor ions 620 waiting for product ion analysis in one mass-to-charge ratio channel. Each exemplary mass spectrum 630 in FIG. 6 corresponds to the output of one product ion scan event. The solid triangle in FIG. 6 shows one precursor ion scan event 640. It can be seen from the distribution scheme 600 that one cycle includes one precursor ion scan event and three product ion scan events, and one precursor ion mass spectrum (not shown) and three product ion mass spectra 630 are output correspondingly.

If it is assumed that different precursor ions 620 in three mass-to-charge ratio channels are found during the precursor ion scan event 650 in the first cycle, the three mass-to-charge ratio channels for these precursor ions will be distributed to three product ion scan events which, respectively corresponding to the three product ion mass spectra 630 in the drawing, are respectively numbered as product ion scan events 1, 2 and 3 in this drawing from up to down. This numbering rule will be followed in the subsequent cycle 660. Then, following the first cycle, precursor ions in two new mass-to-charge ratio channels are found during the precursor ion scan event 660 in the second cycle. The distribution order of the mass-to-charge ratio channels for the precursor ions already found in the previous cycle remains unchanged, and the two mass-to-charge ratio channels for the newly found precursor ions are distributed to product ion scan events that are respectively numbered as 1 and 2. Precursor ions in three new mass-to-charge ratio channels are found during the precursor ion scan event in the third circle 670. The distribution rule for the first five precursor ion mass-to-charge ratio channels remains unchanged, and the three newly found precursor ion mass-to-charge ratio channels are respectively distributed to three product ion scan events that are respectively numbered as 3, 1 and 2. After the number of ion mass-to-charge ratio channels accepted by a product ion scan event with any serial number reaches an upper limit (three), this scan event will not accept precursor ions in any new mass-to-charge ratio channel any more. This event is terminated after it is continuously implemented for one chromatographic peak width time (generally 30 s) with the progress of the cycle, and an event with this serial number in the next cycle will be used to accept newly found precursor ion mass-to-charge channels. If it is assumed that there are few substances in the sample to be analyzed and the number of precursor ion mass-to-charge ratio channels distributed to all or part of the product ion scan events cannot reach the upper limit (three), when the number of precursor ion mass-to-charge ratio channels included in the product ion scan events does not increase any more, this event will be terminated after it is continuously implemented for one chromatographic peak width time (generally 30 s) with the progress of the cycle, and an event with this serial number in the next cycle will be used to accept new precursor ion mass-to-charge ratio channels.

In the above distribution scheme 600, precursor ions in different mass-to-charge ratio channels present at the same time are maximally distributed to different product ion scan events, so that the mutual interference between different analytes is reduced and the subsequent data analysis becomes more effective.

When the data acquisition method of FIGS. 4 and 5 is performed by a mass spectrometer, precursor ion mass-to-charge ratio channels are derived from the pre-established database, and the appearance order of each precursor ion mass-to-charge ratio channel is known, so that the distribution becomes simpler. As a preferred embodiment, the basic principle for the distribution is the same as the method of FIG. 6. That is, to make full use of the product ion scan events and reduce the mutual interference between the concurrent precursor ions in different mass-to-charge ratio channels, the precursor ion mass-to-charge ratio channels are uniformly distributed to different product ion scan events.

Compared with the conventional data-dependent acquisition methods, the multiple data dependent acquisition method of the present invention has a higher ion utilization efficiency and a better quantitative ability. The specific description will be given as below. FIG. 7 shows a schematic diagram of a conventional data-dependent acquisition method, where the vertical axis represents the mass-to-charge ratio 710 and the horizontal axis represents the number of times of scan 770. When a mass spectrometer performs data-dependent acquisition, one precursor ion scan 720 is first performed; and then, according to the measured mass-to-charge ratio and ion intensity information of precursor ions, precursor ions 730, 740 and 750 with a higher intensity in several mass-to-charge ratio channels are then selected for successive fragmenting and product ion scan, where one mass spectrometry data acquisition cycle 760 generally includes one precursor ion scan event and a plurality of product ion scan events. Since the measured abundance of the precursor ions are inconsistent during each precursor ion scan, the precursor ion mass-to-charge ratio channels corresponding to the product ion scan events in each cycle are different, so that it cannot be ensured that the mass spectra of product ions of an analyte are uniformly acquired for multiple times within the chromatographic elution time. Therefore, this method performs quantitative analysis only by using the ion current chromatogram of the precursor ions of the analyte rather than the ion current chromatogram of the product ions.

However, by the mass spectrometry data acquisition method of the present invention, the product ion response of precursor ions in a plurality of mass-to-charge ratio channels is monitored simultaneously during each product ion scan, so that the ion duty cycle is significantly improved in comparison with the data-dependent acquisition method. Meanwhile, product ions of the analyte are uniformly acquired for multiple times within the chromatographic elution time, and quantitative analysis may be performed by using the ion current chromatogram of the product ions.

Therefore, a better anti-interference performance and a higher signal-to-noise ratio are realized.

In addition, compared with the existing data-independent acquisition methods, the mass spectrometry data acquisition method of the present invention has a higher ion utilization efficiency. The specific description will be given as below. FIG. 8 shows a schematic diagram of an existing data-independent acquisition method, where the vertical axis represents the mass-to-charge ratio 810 and the horizontal axis represents the number of times of scan 850. The mass spectrometer first performs one precursor ion scan 820 within the full mass-to-charge ratio range, then uniformly divides the full mass-to-charge ratio selection into several mass-to-charge ratio windows 830 each generally having a width of 10-30 amu, and successively performs precursor ion fragmenting and product ion scan for all precursor ions within each window. One precursor ion scan and several product ion scan form one scan cycle 840. Compared with the conventional data-dependent acquisition methods, by this method, product ions of the precursor ions may be uniformly acquired for multiple times during the chromatographic elution time of the analyte, and the ion current chromatogram of the product ions may be used for quantitative analysis. However, in this method, product ions in all mass-to-charge windows, including mass-to-charge ratio windows without precursor ions, are scanned once in each scan cycle indiscriminately, so that the scan capability of the mass spectrometer is not fully utilized and the duty cycle is reduced.

By the mass spectrometry data acquisition method of the present invention, precursor ion mass-to-charge ratio channels may be selected in real time according to the ions detected during the precursor ion scan, and the duty cycle of the precursor ions is improved greatly.

FIGS. 9A-9B are three-dimensional graphs of a preferred data processing instance applied to the data acquisition method of FIGS. 2 and 3. FIG. 9A shows an exemplary precursor ion spectrum from the 101st cycle to the 114th cycle, and FIG. 9B shows a product ion spectrum from the 101st cycle to the 114th cycle, where the x-axes in the three-dimensional graphs represent the number of repetitions of scan 920 and 970, i.e., the number of cycles; the y-axes 930 and 980 represent the mass-to-charge ratio of ions; and the z-axes 910 and 960 represent the response of ions on the mass spectrometer detector.

In FIG. 9A, the bars, present in a section which is intersected with the points on the horizontal axis and parallel to the xz plane, represent the mass spectrum of precursor ions in the current cycle. As an example, the bars in the section shown by the shade 940 represent the mass spectra obtained by the precursor ion scan in the 104th cycle. Similarly, in FIG. 9B, the bars, present in a section which is intersected with the points on the horizontal axis and parallel to the xz plane, represent the mass spectrum of product ions obtained by one product ion scan event in the current cycle. As an example, the bars in the section shown by the shade 990 represent the mass spectrum obtained by the product ion scan event numbered as 1 in the 102nd cycle.

The mass spectrum of product ions obtained by the mass spectrometry data acquisition method of the present invention is generally a mixed mass spectrum of precursor ions in a plurality of mass-to-charge ratio channels. To perform the subsequent qualitative and quantitative analysis, as a preferred solution, the retention time and the shape of a chromatographic peak are used as the standard for deconvolution. The mass spectrum of product ions corresponding to a single substance may be restored by deconvolution. It can be seen from FIG. 9B that the product ions having a mass-to-charge ratio of m/z 210, m/z 311 and m/z 408 manifest a considerable ion intensity change rule 951 during the 105th to 112nd cycles, i.e., have the same chromatographic peak and elution time. Therefore, it can be determined that the three product ions originate from the same substance. Meanwhile, as shown in FIG. 9A, the precursor ion having a mass-to-charge ratio of m/z 721 manifests the same ion intensity change rule 950 as the three product ions during the 105th to 112nd cycles. Thus, the three product ions having a mass-to-charge ratio of m/z 210, m/z 311 and m/z 408 are associated with the precursor ion having a mass-to-charge ratio of m/z 721, which reconstructed a new pure mass spectrum of product ions corresponding to a single substance. [[.]] Meanwhile, the intensity of the chromatographic peaks 1050 and 1100 or the peak areas thereof may be used for the quantitative analysis of a substance with precursor ions having a mass-to-charge ratio of m/z 721.

In conclusion, the mass spectrometry data acquisition method of the present invention effectively overcomes various disadvantages in the prior art and has a high industrial utilization value.

The embodiments are merely for illustratively describing the principle and effects of the present invention, and not intended to limit the present invention. Those skilled in the art may make modifications or alterations to the embodiments without departing from the spirit and scope of the present invention. Therefore, all equivalent modifications or alterations made by those skilled in the art without departing from the spirit and technical idea of the present invention shall be incorporated by the claims of the present invention.

The invention claimed is:

1. A mass spectrometry data acquisition method comprising the steps of:

a. providing at least one ion source for generating ions;

b. said ions being not fragmented or partially fragmented when a collision cell is in a first working mode;

c. recording a mass spectrum of the ions generated in said first working mode as a first fragmenting spectrum;

d. selecting more than one ion from said ions, the more than one ion being distributed in a plurality of discontinuous mass-to-charge ratio channels;

e. said selected more than one ion being at least partially fragmented when the collision cell is in a second working mode;

f. recording a mass spectrum of the ions generated in said second working mode as a second fragmenting spectrum; and g. repetitively executing the steps b-f for several times, wherein, when the step d is repetitively executed, the ions, which are distributed in the discontinuous mass-to-charge ratio channels, selected in the previous step d are always selected, until the ion intensity of said selected ions is lower than a set threshold, wherein the number of said mass-to-charge ratio channels for the selected ions is not greater than a set numerical value.

2. The mass spectrometry data acquisition method as claimed in claim 1, wherein the data acquisition method is applied to data acquisition of a chromatography—mass spectrometry system.

3. The mass spectrometry data acquisition method as claimed in claim 2, wherein ions present in the first fragmenting spectrum and ions present in the second fragmenting spectrum are associated with each other according to the elution time of the chromatography peaks.

4. The mass spectrometry data acquisition method as claimed in claim 2, wherein ions present in the first fragmenting spectrum and ions present in the second fragmenting spectrum are associated with each other according to the shape of chromatographic peaks.

5. The mass spectrometry data acquisition method as claimed in claim 2, wherein ions present in the first fragmenting spectrum and ions present in the second fragmenting spectrum are associated with each other according to both the elution time and the shape of the chromatographic peaks.

6. The mass spectrometry data acquisition method as claimed in claim 1, wherein said set numerical value is changed in real time according to the complexity of a sample to be analyzed.

7. The mass spectrometry data acquisition method as claimed in claim 1, wherein when the number of said mass-to-charge ratio channels of said selected ions does not increase any more or reaches the set numerical value, said selection is terminated after the steps b-f are further executed for a preset number of times, and a new selection is activated when the steps b-f are further executed next time.

8. The mass spectrometry data acquisition method as claimed in claim 1, wherein during one repetitive execution of the steps b-f, the step d further comprises the step of selecting more than one ion from said ions by multiple batches; and, the step f further comprises the step of respectively recording a mass spectrum of ions originated from fragmentation in each batch as a second fragmenting spectrum thereof.

9. The mass spectrometry data acquisition method as claimed in claim 8, wherein during the selections by multiple batches, said mass-to-charge ratio channels for the ions selected in respective batches are different.

10. A mass spectrometry data acquisition method comprising the steps of:

a. providing at least one ion source for generating ions;
b. said ions being not fragmented or partially fragmented when a collision cell is in a first working mode;
c. recording a mass spectrum of the ions generated in said first working mode as a first fragmenting spectrum;
d. selecting more than one ion from said ions, the more than one ion being distributed in a plurality of discontinuous mass-to-charge ratio channels;
e. said selected more than one ion being at least partially fragmented when the collision cell is in a second working mode;
f. recording a mass spectrum of the ions generated in said second working mode as a second fragmenting spectrum; and
g. repetitively executing the steps b-f for several times, wherein, when the step d is repetitively executed, the ions, which are distributed in the discontinuous mass-to-charge ratio channels, selected in the previous step d are always selected, until the ion intensity of said selected ions is lower than a set threshold, wherein during one repetitive execution of the steps b-f, the step d further comprises the step of selecting more than one ion from said ions by multiple batches; and, the step f further comprises the step of respectively recording a mass spectrum of ions originated from fragmentation in each batch as a second fragmenting spectrum thereof; and wherein when the number of said mass-to-charge ratio channels for the selected ions does not increase any more or reaches a set numerical value during the selection in a certain batch, the selection in this batch is terminated after the steps b-f are further executed for a preset number of times.

11. The mass spectrometry data acquisition method as claimed in claim 8, wherein said mass-to-charge ratio channels for the generated ions are uniformly distributed in the selections in different batches.

12. The mass spectrometry data acquisition method as claimed in claim 1, wherein said mass-to-charge ratio channels have a mass-to-charge ratio width of greater than 1 amu.

13. The mass spectrometry data acquisition method as claimed in claim 1, wherein said selected ions simultaneously enter the collision cell, or successively enter the collision cell depending on different mass-to-charge channels.

14. A mass spectrometry data acquisition method comprising the steps of:

a. providing at least one ion source for generating ions;
b. selecting more than one ion from said ions, the more than one ion being distributed in a plurality of discontinuous mass-to-charge ratio channels;
c. allowing the selected ions to pass through a collision cell to be at least partially fragmented;
d. recording a mass spectrum of the ions generated in the step c; and
e. repetitively executing the steps b-d for several times, wherein, each time the step b is executed, the ions, which are distributed in the discontinuous mass-to-charge ratio channels, selected in the previous step b are always selected, until the ion intensity of said selected ions is lower than a set threshold, wherein during one repetitive execution of the steps b-d, the step b further comprises the step of selecting more than one ion from said ions by multiple batches; and, the step d further comprises the step of respectively recording a mass spectrum of ions originated from fragmentation in each batch; and wherein during the selections in multiple batches, the number of repetition times and the starting/ending time for each batch are determined according to a database in advance.

15. The mass spectrometry data acquisition method as claimed in claim 14, wherein after the steps b-d are repetitively executed for a preset number of times, the selection is terminated, and a new selection is activated when the steps b-d are repetitively executed next time.

16. The mass spectrometry data acquisition method as claimed in claim 14, wherein during the selections in multiple batches, the mass-to-charge ratio channels for the ions selected in respective batches are different.

17. The mass spectrometry data acquisition method as claimed in claim 14, wherein after the selection in a certain batch, among the selections in multiple batches, has been repetitively executed for a preset number of times, the selection in this batch is terminated.

18. A mass spectrometry data acquisition method comprising the steps of:

a. providing at least one ion source for generating ions;
b. selecting more than one ion from said ions, the more than one ion being distributed in a plurality of discontinuous mass-to-charge ratio channels;
c. allowing the selected ions to pass through a collision cell to be at least partially fragmented;
d. recording a mass spectrum of the ions generated in the step c; and
e. repetitively executing the steps b-d for several times, wherein, each time the step b is executed, the ions, which are distributed in the discontinuous mass-to-charge ratio channels, selected in the previous step b are always selected, until the ion intensity of said selected ions is lower than a set threshold, wherein during one repetitive execution of the steps b-d, the step b further comprises the step of selecting more than one ion from said ions by multiple batches; and, the step d further comprises the step of respectively recording a mass spectrum of ions originated from fragmentation in each batch; and wherein during the selections in multiple batches, the mass-to-charge ratio channels for the selected ions are determined according to a database in advance.

19. The mass spectrometry data acquisition method according to claim 18, wherein said database is generated by simulation software.

20. The mass spectrometry data acquisition method according to claim 18, wherein said database is generated by chromatography—mass spectrometry analysis performed in advance.

21. The mass spectrometry data acquisition method as claimed in claim 14, wherein said mass-to-charge ratio channels have a mass-to-charge ratio width of greater than 1 amu.

22. The mass spectrometry data acquisition method as claimed in claim 14, wherein the selected ions simultaneously enter the collision cell, or successively enter the collision cell depending on different mass-to-charge channels.

23. The mass spectrometry data acquisition method as claimed in claim 14, further comprising the step of: after obtaining the mass spectrum, retrieving a database containing pre-stored mass spectra of known substances to judge whether the acquired mass spectrum corresponds to one or more known substances.

24. The mass spectrometry data acquisition method as claimed in claim 23, wherein said retrieving process comprises the following steps of:

a) obtaining, from the database, mass spectra of the known substances;

b) generating a time-varying ion current chromatogram from product ions present in the mass spectra of the known substances; and c) calculating, according to the obtained ion current chromatogram and the mass spectra of the known substances, a score for judging whether the known substances have been detected.

25. The mass spectrometry data acquisition method as claimed in claim 24, wherein a quantitative numerical value of the known substances is calculated according to the ion current chromatogram.

26. A mass spectrometry data acquisition method, comprising the steps of:

a. providing at least one ion source for generating ions;

b. the ions bypassing a collision cell to be not fragmented or partially fragmented;

c. recording a mass spectrum of the ions as a first fragmenting spectrum;

d. selecting more than one ion from the ions, the more than one ion being distributed in a plurality of discontinuous mass-to-charge ratio channels;

e. allowing the selected ions to pass through the collision cell to be at least partially fragmented;

f. recording a mass spectrum of the ions generated in the step e as a second fragmenting spectrum; and g. repetitively executing the steps b-f for several times, wherein, when step d is repetitively executed, the ions, which are distributed in the discontinuous mass-to-charge ratio channels, selected in the previous step d are always selected, until the ion intensity of the selected ions is lower than a set threshold, wherein during one repetitive execution of the steps b-f, the step d further comprises the step of selecting more than one ion from said ions in multiple batches; and, the step f further comprises the step of respectively recording a mass spectrum of ions originated from fragmentation in each batch as a second fragmenting spectrum thereof; and wherein the ions are uniformly distributed in the selections in different batches.

27. The mass spectrometry data acquisition method as claimed in claim 26, wherein during the selections in multiple batches, the mass-to-charge ratio channels for the ions selected in respective batches are different.

28. The mass spectrometry data acquisition as claimed in claim 26, wherein when the number of mass-to-charge ratio channels for the selected ions does not increase any more or reaches a set numerical value during the selection in a certain batch, the selection in this batch is terminated after the steps b-f are further repetitively executed for a preset number of times.

29. The mass spectrometry data acquisition method as claimed in claim 26, wherein the selected ions simultaneously enter the collision cell, or successively enter the collision cell depending on different mass-to-charge channels.

* * * * *